US007356266B2

(12) United States Patent
Tokuzaki

(10) Patent No.: US 7,356,266 B2
(45) Date of Patent: Apr. 8, 2008

(54) LASER PRINTER APPARATUS WITH CARTRIDGE DETECTOR

(75) Inventor: Masaaki Tokuzaki, Daito (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 234 days.

(21) Appl. No.: 11/352,568

(22) Filed: Feb. 13, 2006

(65) Prior Publication Data

US 2006/0209163 A1 Sep. 21, 2006

(30) Foreign Application Priority Data

Mar. 18, 2005 (JP) ..... 2005-079531

(51) Int. Cl.
*G03G 15/00* (2006.01)

(52) U.S. Cl. ..... 399/13

(58) Field of Classification Search ..... 399/13, 399/107–126

See application file for complete search history.

(56) References Cited

U.S. PATENT DOCUMENTS 4,912,510 A * 3/1990 Ogura et al. ..... 355/72
6,308,028 B1 * 10/2001 Yashiro et al. ..... 399/111

FOREIGN PATENT DOCUMENTS

JP 04242771 A * 8/1992
JP 3085412 2/2002

OTHER PUBLICATIONS

Japan Patent Office, Application No. 3085412, dated Feb. 6, 2002, with partial English translation (2 pages).

* cited by examiner

*Primary Examiner*—David M. Gray
*Assistant Examiner*—Ryan Gleitz
(74) *Attorney, Agent, or Firm*—Osha Liang LLP

(57) ABSTRACT

A motor feeding a sheet of paper is arranged inside a frame, and below the motor, a motor cover having a detecting portion for detecting presence/absence of a cartridge is attached on a base member. A signal caught by the detecting portion is transmitted through a wire to a substrate portion arranged outside the frame. The base member has a first cut-and-raised portion formed for engaging with the motor cover, and a second cut-and-raised portion formed at a prescribed position. The wire is connected, through a gap formed by the first cut-and-raised portion between the motor cover and the base member and through the second cut-and-raised portion, to the substrate portion. Thus, a laser printer apparatus can be provided in which the wire connecting the detecting portion detecting presence/absence of a cartridge to the substrate portion can be routed to avoid any influence of heat, at a low cost.

6 Claims, 8 Drawing Sheets

LASER PRINTER APPARATUS WITH CARTRIDGE DETECTOR

BACKGROUND OF THE INVENTION

1. Field of the Invention

The present invention relates to a laser printer apparatus and, more specifically, to a laser printer apparatus including a laser scanning unit.

2. Description of the Background Art

A laser printer apparatus is one type of printer apparatuses. As can be seen from FIG. 8, in a laser printer apparatus 101, a prescribed sheet of paper 120 fed from a paper feed inlet 113 of laser printer apparatus 101 passes through a photoreceptor 102, while the photoreceptor 102 is irradiated with a prescribed laser beam in accordance with an image signal, by a laser scanning unit 104. Consequently, toner is transferred to the sheet of paper 120. The sheet of paper 120 on which the toner has been transferred has its toner fixed in a fixing unit 105, and then the sheet is discharged from a discharge outlet 114. In this type of laser printer apparatus 101, a cartridge 103 containing the toner to be supplied to the photoreceptor 102 is taken in and out through a prescribed door for maintenance, and after it is detected by a prescribed detecting portion (not shown) that cartridge 103 is attached to laser printer apparatus 101, a prescribed printing operation takes place.

In laser printer apparatus 101, as a framework of laser printer body, a pair of frames (not shown) are arranged to be opposite to each other. Cartridge 103, photoreceptor 102, fixing unit 105 and laser scanning unit 104 are respectively arranged at prescribed positions within the pair of frames. A motor (not shown) for driving laser printer apparatus 101, including feeding of the sheet of paper 120 (represented by a dotted arrow), is arranged at a prescribed position outside the pair of frames. A substrate portion (not shown) controlling operations of laser printer apparatus 101 is arranged outer than one of the pair of frames. The substrate is electrically connected to the detecting portion detecting attachment of cartridge 103 through a prescribed wire. Japanese Utility Model Registration No. 3085412 discloses an example of the wiring structure in the laser printer apparatus.

The conventional laser printer apparatus, however, has the following problems. Laser printer apparatus 101 has been made smaller and smaller and in that course, it becomes desirable to arrange the motor within the pair of frames. When the motor is to be arranged within the pair of frames, the motor must be placed close to cartridge 103 while not interfering the operation of putting-in or taking-out cartridge 103 at the time of maintenance.

If the motor were placed close to cartridge 103, however, a wire connecting the sensor detecting the cartridge 103 to the substrate would be affected by the heat from the motor. If the wire were positioned to avoid the influence of heat from the motor, the wire would be closer to the fixing unit. The fixing unit fixes at a temperature of about 200° C., and therefore, the wire would be affected by the heat from the fixing unit. If the wire is formed of a wire material having high heat resistance in order to avoid the influence of heat, the cost increases, and if the wire is routed to avoid both the motor and the fixing unit, the wire length becomes long and the wire would be more susceptible to noise.

SUMMARY OF THE INVENTION

The present invention was made in view of the foregoing and its object is to provide a laser printer apparatus in which a wire connecting a sensor for detecting presence/absence of a cartridge to a substrate portion can be routed so as not to be affected by heat, while preventing cost increase.

The laser printer apparatus in accordance with the present invention includes a pair of frames, a base member, a photoreceptor, a cartridge, a laser scanning unit, a fixing unit, a motor, a motor cover member, a detecting portion, a substrate portion and a wire. The pair of frames are arranged to be opposite to each other. The photoreceptor is arranged below the base member, and transfers toner for printing an image on a prescribed sheet of paper. The cartridge is detachably arranged below the base member and opposite to the photoreceptor, and supplies toner. The laser scanning unit is positioned on the base member and irradiates the photoreceptor with a laser beam based on a prescribed image signal. The fixing unit is arranged next to the base member above the photoreceptor, and fixes the toner transferred onto the sheet of paper. The motor is arranged inside one of the pair of frames, and applies driving-force for feeding the sheet of paper. The motor cover member is attached to the base member and covers the motor from below. The detecting portion is attached to the motor cover member, and detects presence/absence of the cartridge. The substrate portion is arranged outside one frame, and controls the printing operation. The wire connects the detecting portion and the substrate portion: The base member includes a first cut-and-bent portion for holding the motor cover member, and a second cut-and-bent portion formed between the motor and the fixing unit, apart from the first cut-and-bent portion. The wire is taken out from a gap between the motor cover and the first cut-and-bent portion, held by the second cut-and-bent portion and connected to the substrate portion.

By this structure, in a laser printer apparatus having the motor arranged inside the framework to reduce the size, the wire connecting the detecting portion to the substrate portion is routed through prescribed first and second cut-and-bent portions formed in the base member on which the motor cover having the detecting portion arranged thereon is mounted, so that the wire can be connected free from any influence of heat from the motor or the fixing unit, in a relatively short distance without increasing the cost.

According to another aspect, the present invention provides a laser printer apparatus having a laser scanning unit, including a prescribed base member, a detecting portion, a driving portion, a fixing unit, a substrate portion and a wire. The base member has the laser scanning unit positioned thereon. The detecting portion is arranged below one of a pair of first end portions opposite to each other of the base member, and determines presence/absence of a cartridge that supplies toner for image printing and is put-in/taken-out in a prescribed direction. The driving portion is arranged on a side of one of the pair of first end portions of the base member, and feeds the sheet of paper. The fixing unit is arranged next to the base member on a side of one of a pair of second end portions opposite to each other in a direction approximately orthogonal to the direction in which the pair of first end portions of the base member oppose to each other, and fixes the toner transferred to the sheet by the laser scanning unit. The substrate portion is arranged on that side of the driving portion which is opposite to the position of the base member, and controls the printing operation. The wire connects the detecting portion to the substrate portion. The wire is passed from the detecting unit through a prescribed opening that penetrates the base member, and passed between the driving portion and the fixing unit, to be connected to the substrate.

By this structure, the wire connecting the detecting portion and the substrate portion is routed through a prescribed opening formed in the base member on which the motor cover having the detecting portion arranged thereon is mounted and passed between the driving portion and the fixing unit, so that the wire can be connected free from any influence of heat from the motor or the fixing unit, in a relatively short distance without increasing the cost.

Preferably, a driving portion covering member covering the driving portion from below is provided, the detecting portion is attached on the driving portion covering member, and the prescribed opening may be a gap formed in the base member on the side of the fixing unit at the attachment portion of the driving portion covering member and the base member. In this manner, it becomes unnecessary to separately form an opening in the base member, and the gap between the driving portion covering member and the base member can be used.

By providing the first cut-and-bent portion in the base member for holding the driving portion covering member, the gap can reliably be formed.

Further, it is preferred to form the second cut-and-bent portion at the end portion of the base member on the side of the fixing unit, in order to reliably pass the wire between the driving portion and the fixing unit. By holding the wire at the second cut-and-bent portion, the wire can be connected to the substrate.

Further, preferably, a pair of frames supporting the pair of first end portions of the base member are provided, the driving portion is arranged inside one of the pair of frames and the substrate is arranged outside the one frame, whereby the laser printer apparatus can be made smaller.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
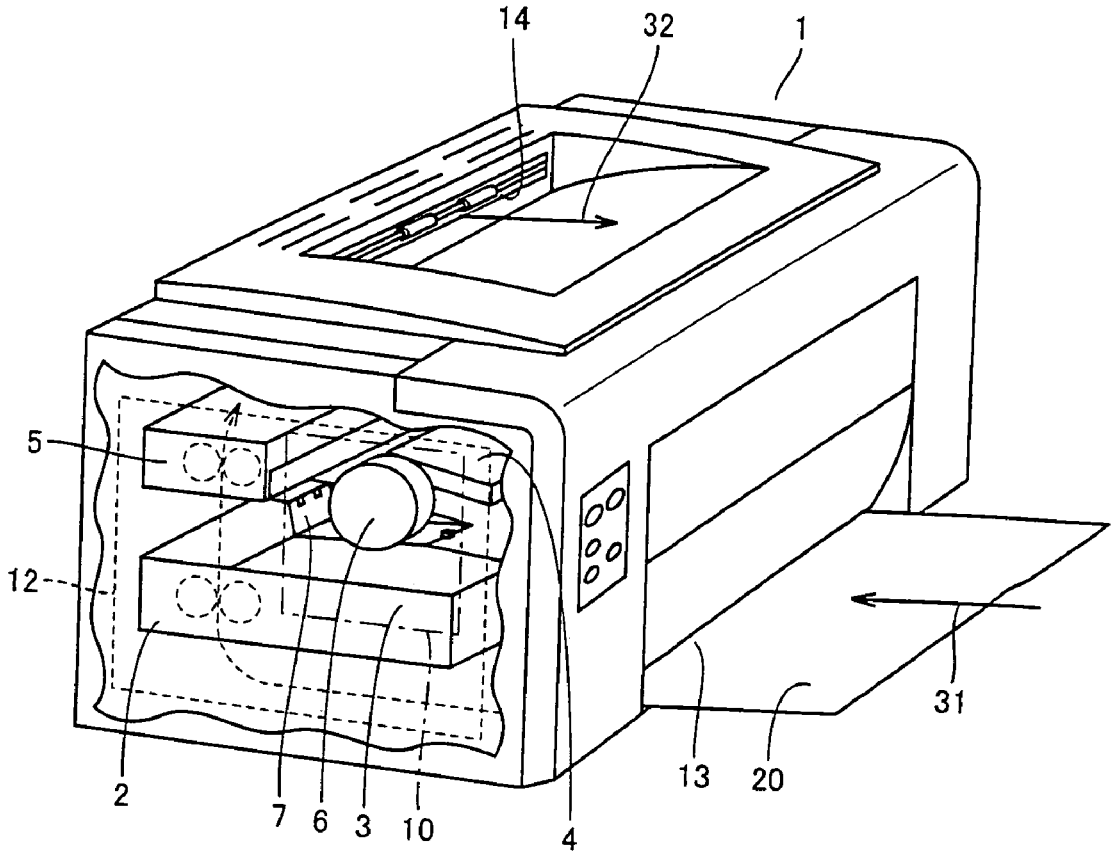
FIG. 1 is an exploded perspective view showing a laser printer apparatus in accordance with an embodiment of the present invention.
Figure 2:
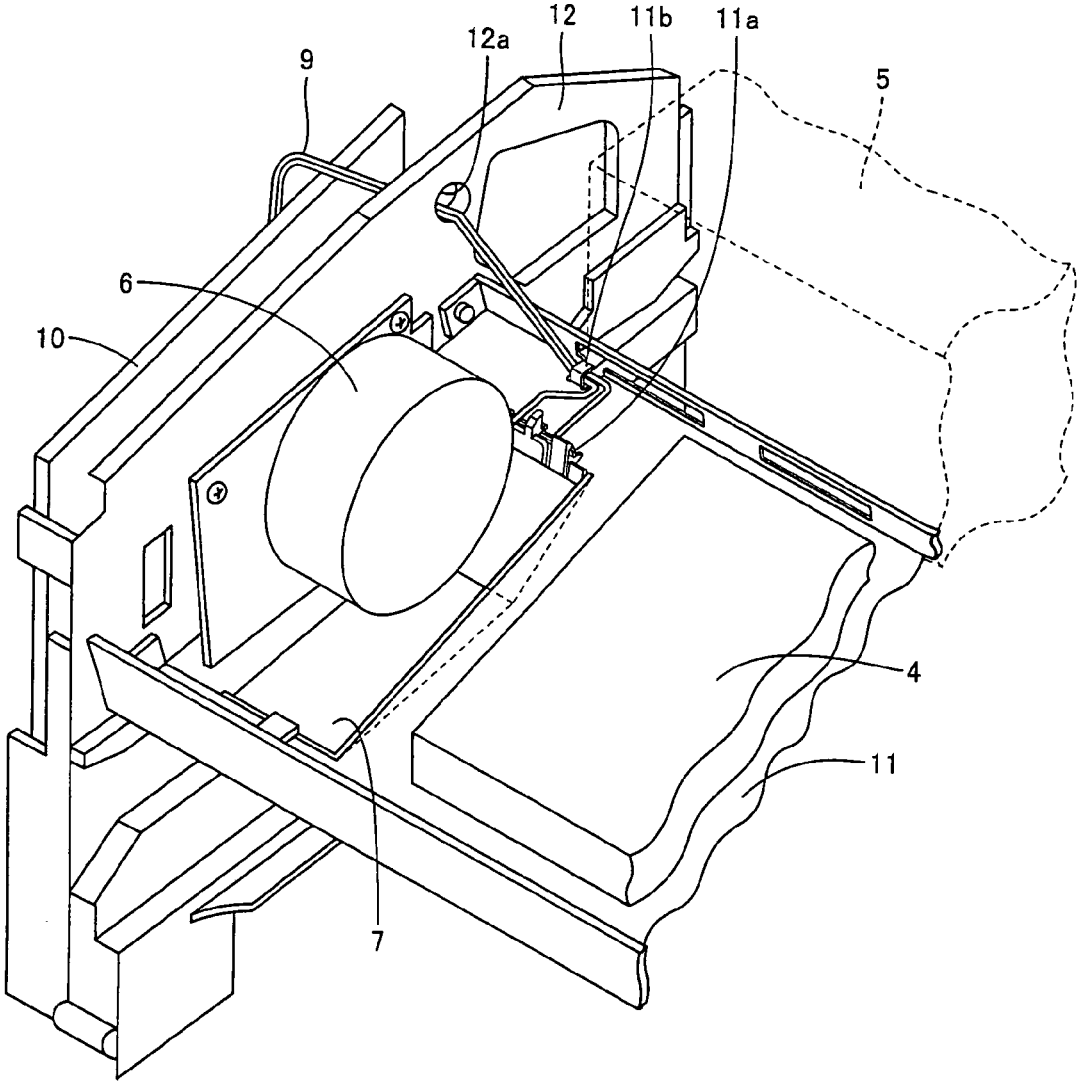
FIG. 2 is a partial perspective view showing routing of a wire at an attachment portion between the base member and the frame, in accordance with the embodiment.
Figure 3:
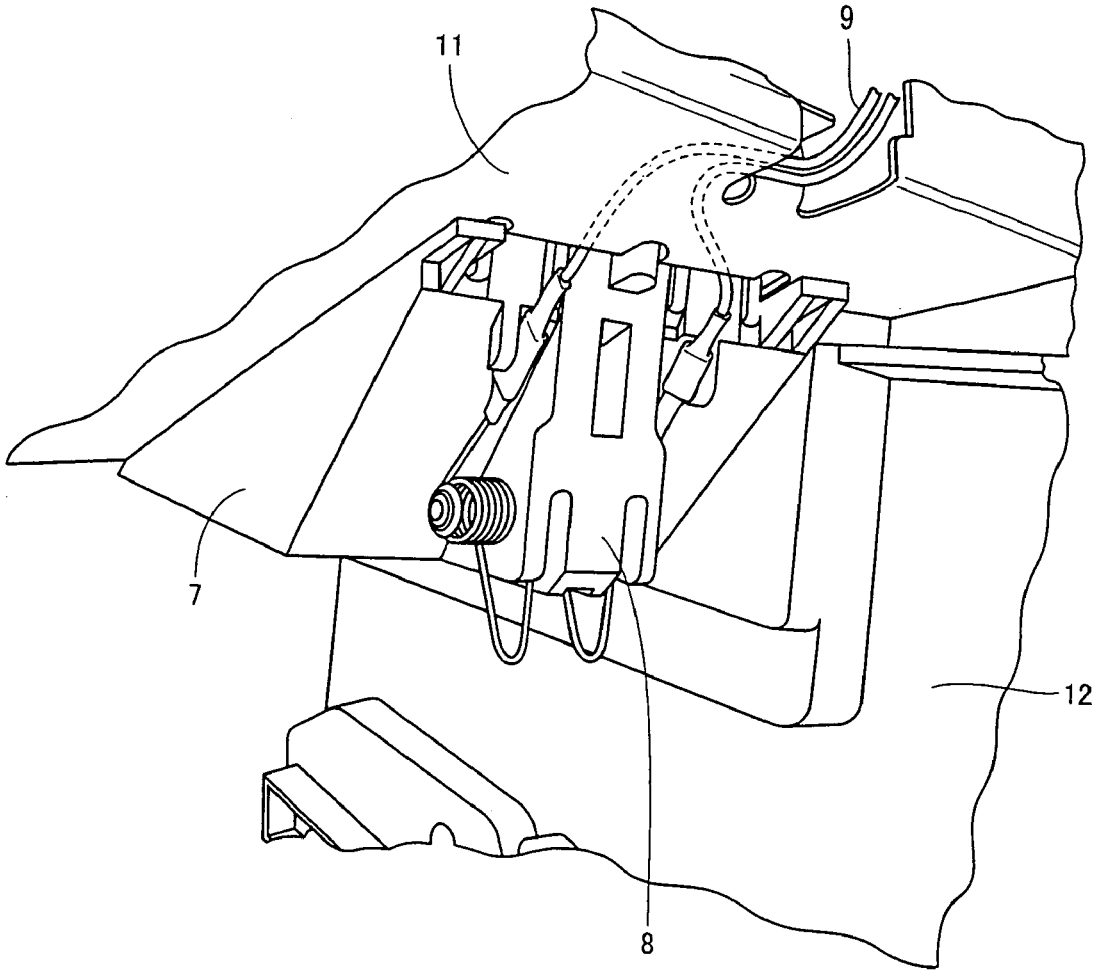
FIG. 3 is a partial perspective view showing the detecting portion attached to a motor cover, in accordance with the embodiment.

The laser printer apparatus in accordance with the present embodiment will be described. As shown in FIGS. 1 and 2, in a laser printer apparatus 1, a pair of frames 12 (only one is shown) is arranged opposite to each other as a framework, and a prescribed base member 11 is fixed to and across the frames 12. Below the base member 11, a photoreceptor 2 that transfers toner to a prescribed sheet of paper 20 for printing an image is arranged. Further, below the base member 11, a cartridge 3 supplying toner is arranged, opposite to photoreceptor 2.

Above the photoreceptor 2, a fixing unit 5 for fixing the toner transferred onto the sheet of paper 20 is arranged next to base member 11. On base member 11, a laser scanning unit 4 irradiating photoreceptor 2 with a laser beam based on a prescribed image signal is positioned. In this manner, photoreceptor 2, cartridge 3, fixing unit 5 and laser scanning unit 4 are arranged at prescribed positions in an area between the pair of frames 12.

Further, in order to reduce the size of the apparatus, in laser printer apparatus 1, a motor 6 as a driving source for operations including feeding of the sheet of paper 20 is arranged inner than one of the pair of frames 12 (within the pair of frames), as shown in FIG. 2. Here, it is the case that motor 6 is arranged at a position close to cartridge 3. Therefore, below motor 6, a motor cover 7 is provided for covering the motor from below. Motor cover 7 is attached to base member 11.

Figure 4:
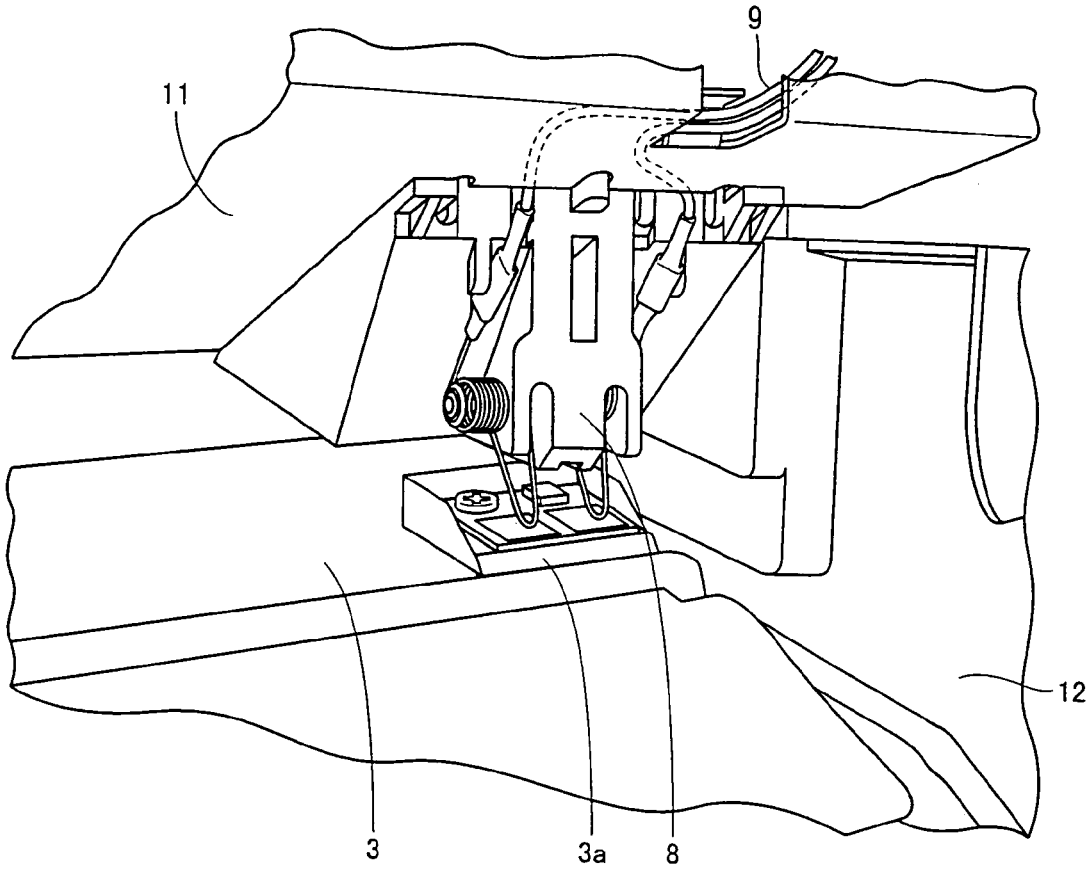
FIG. 4 is a partial perspective view showing the detecting portion when the cartridge is mounted, in accordance with the embodiment.
Figure 5:
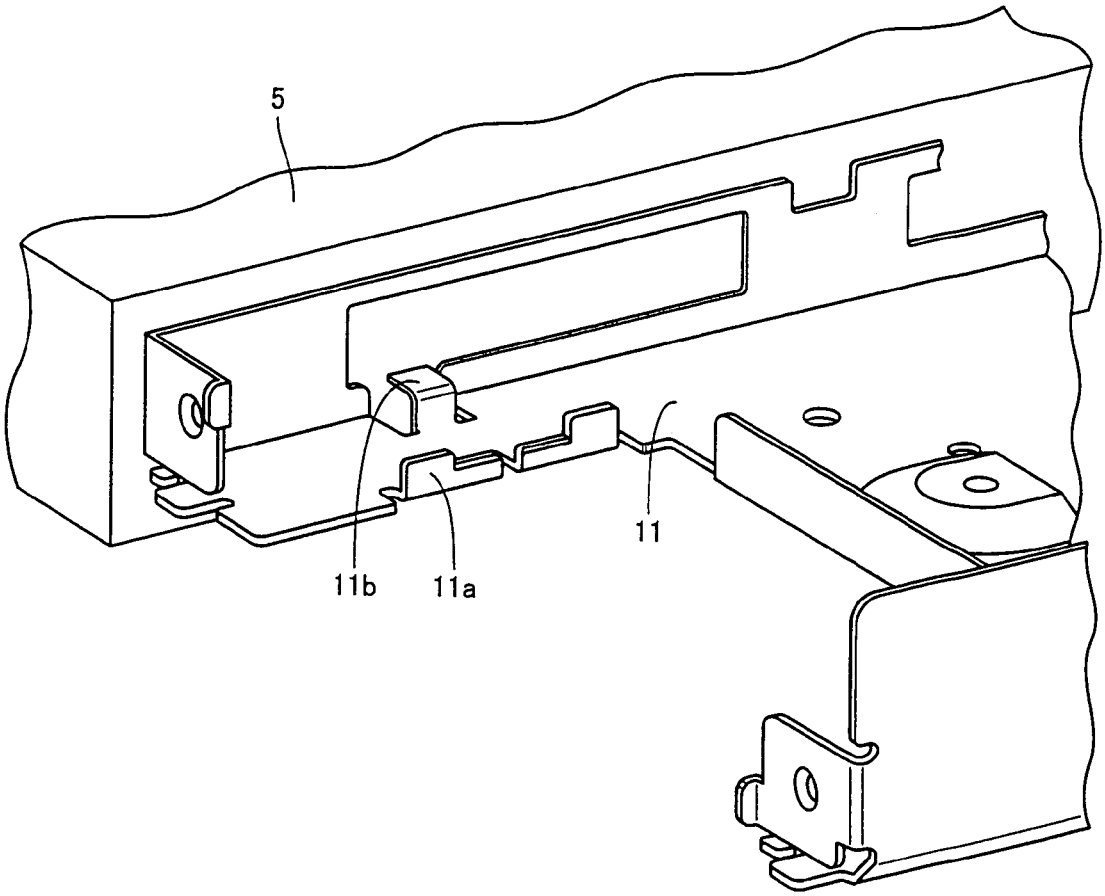
FIG. 5 is a partial perspective view showing the cut-and-bent portion of the base member in accordance with the embodiment.

On motor cover 7, a detecting portion 8 for detecting whether cartridge 3 is mounted on laser printer apparatus 1 or not is provided. As shown in FIG. 4, when cartridge 3 is mounted on laser printer apparatus 1, a prescribed contact portion 3*a* of cartridge 3 is brought into contact with detecting portion 8, so that mounting of cartridge 3 is detected.

The signal caught by detecting portion 8 will be transmitted through a wire 9 to a substrate portion 10 that controls the printing operation of laser printer apparatus 1. Substrate portion 10 is arranged outside one frame 12, as shown in FIG. 2.

Next, routing of wire 9 that connects detecting portion 8 and substrate portion 10 will be described in detail. First, on base member 11, a first cut-and-raised portion 11*a* is provided, which is formed by bending upward a prescribed portion of base member 11. Further, apart from the first cut-and-raised portion 11*a*, a second cut-and-raised portion 11*b* is formed, between the first cut-and-raised portion 11*a* and fixing unit 5.

Figure 6:
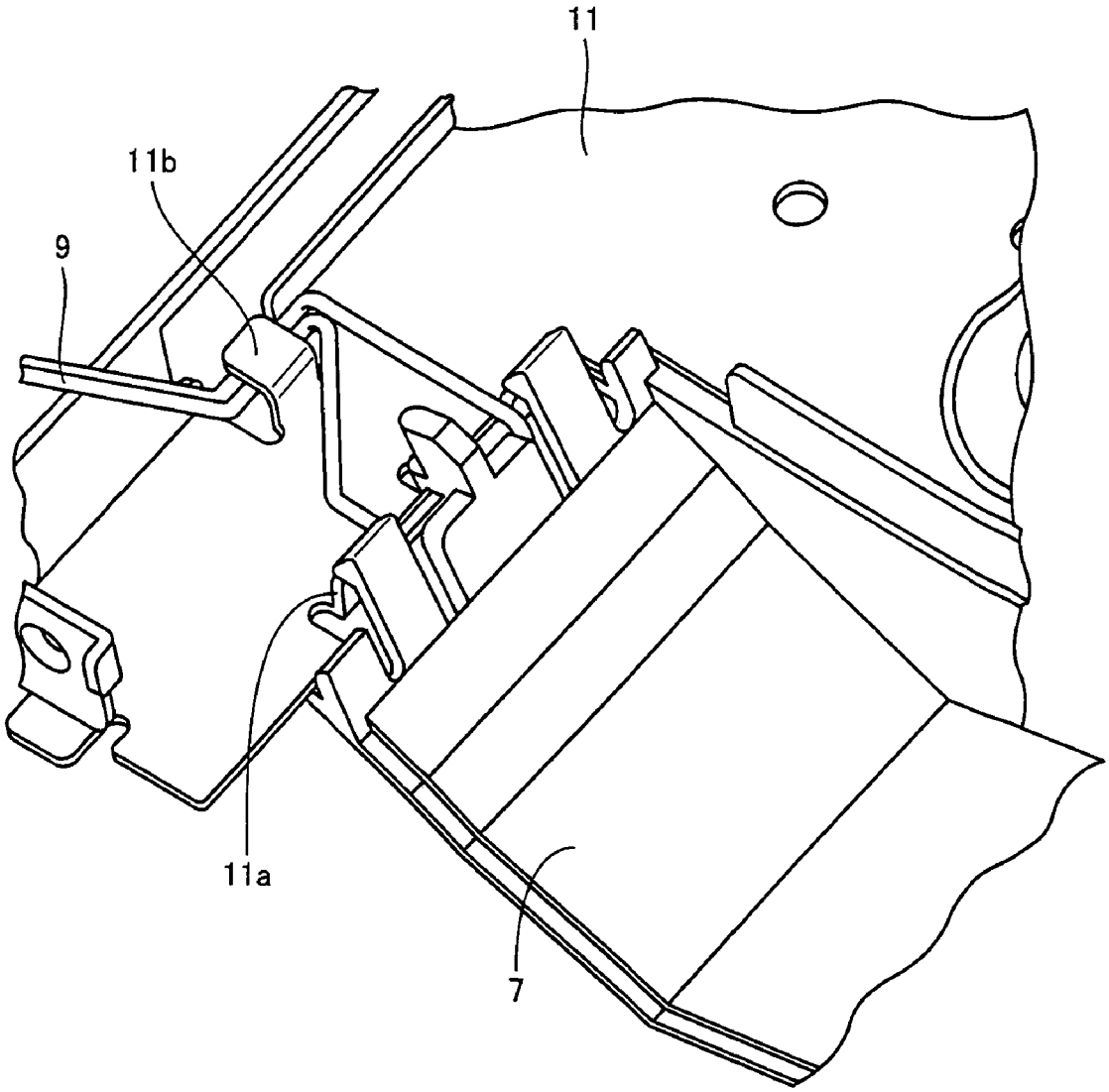
FIG. 6 is a first partial perspective view showing routing of the wire near the cut-and-bent portion of the base member in accordance with the embodiment.
Figure 7:
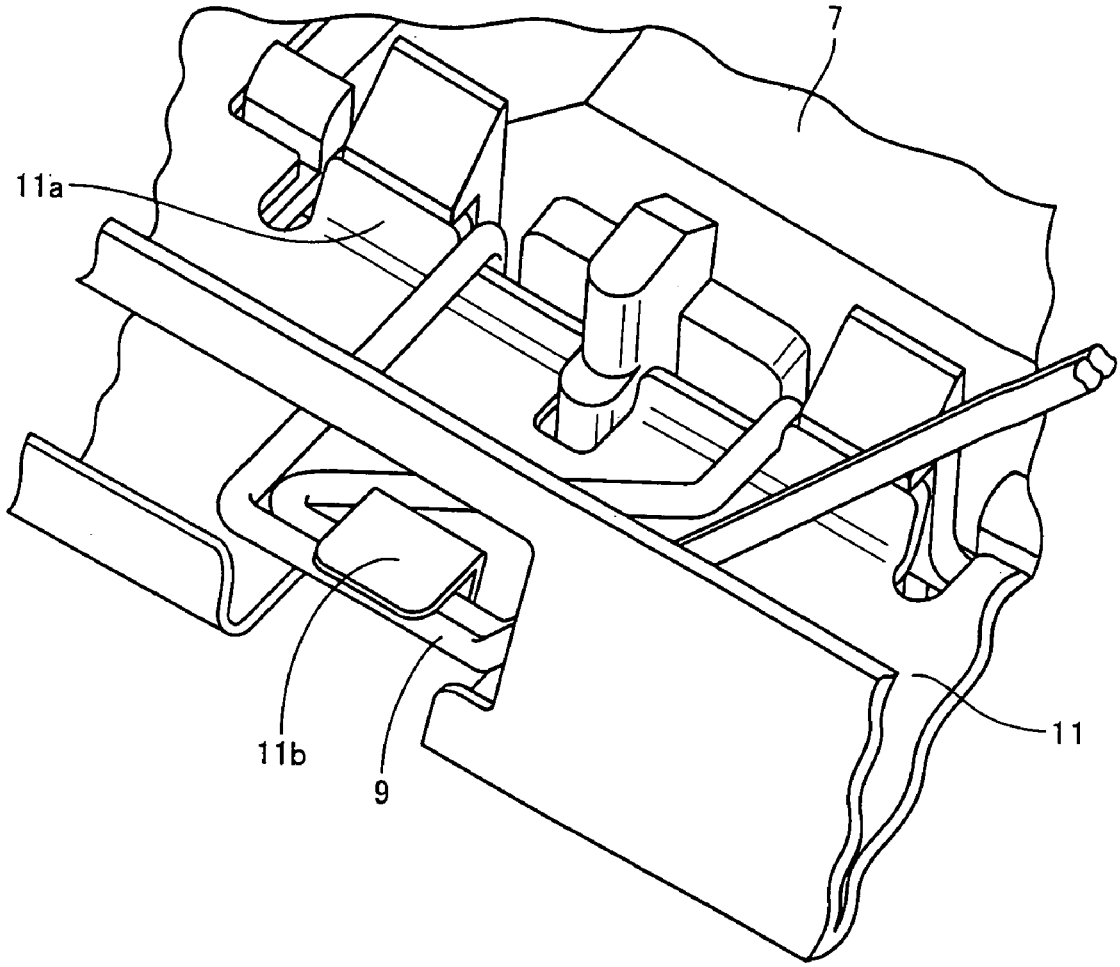
FIG. 7 is a second partial perspective view showing the routing of the wire near the cut-and-bent portion of the base member in accordance with the embodiment.
Figure 8:
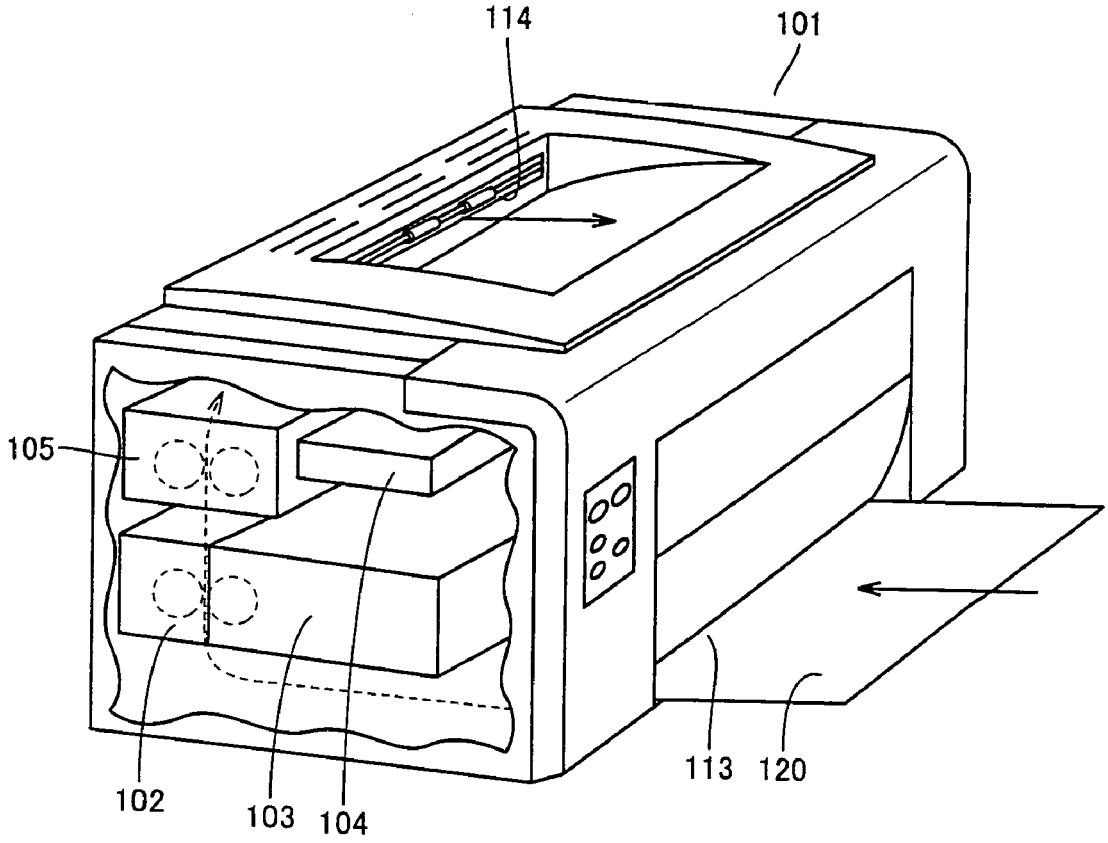
FIG. 8 PRIOR ART
FIG. 8 is a perspective view showing a conventional laser printer apparatus.

As shown in FIGS. 6 and 7, wire 9 runs through a space formed by the first cut-and-raised portion 11*a* between motor cover 7 and base member 11 with motor cover 7 attached to base member 11, and drawn from the back side of base member 8, on which detecting portion 8 is arranged, to the front side. The wire 9 drawn to the front side of base member 11 is then held by the second cut-and-raised portion 11*b*, and connected through a prescribed opening 12*a* formed in frame 12 to substrate portion 10. Laser printer apparatus 1 in accordance with the present embodiment is structured as described above.

Next, an operation of laser printer apparatus 1 above will be described. First, when cartridge 3 containing toner is mounted in laser printer apparatus 1, contact portion 3*a* provided on cartridge 3 is brought into contact with contact portion 8, and a signal indicating appropriate mounting of cartridge 3 is transmitted through wire 9 to substrate portion 10.

Next, a prescribed sheet of paper 20 fed (as represented by an arrow 31) from paper feed inlet 13 or from a paper feed tray (not shown) of laser printer apparatus 1 is fed to photoreceptor 2 (see FIG. 1). Photoreceptor 2 is irradiated with a prescribed laser beam derived from an image signal from laser scanning unit 4, and as the sheet of paper 20 passes over photoreceptor 2, the toner is transferred onto the sheet 20 in accordance with the laser beam irradiation. The sheet of paper 20, on which the toner has been transferred, is fed to fixing unit 5. At fixing unit 5, a process of fixing the toner on the sheet 20 at a prescribed temperature of about 200° C. is performed. The sheet of paper 20 with the fixing process completed is discharged (as represented by an arrow 32) from discharge outlet 14. In this manner, the printing process by laser printer apparatus 1 is finished.

In laser printer apparatus 1 described above, motor 6 is arranged inside frame 12, and on motor cover covering motor 6, detecting portion 8 for detecting mounting of cartridge 3 is provided. Wire 9 connected to detecting portion 8 is connected through a gap at the first cut-and-raised portion 11*a* formed in base member 11 and through the second cut-and-raised portion 11*b*, to substrate portion 10 arranged outside frame 12.

In this manner, as wire 9 is first drawn to the front side of base member 11 through the gap at the first cut-and-raised portion 11*a*, undesirable contact with cartridge 3 or accidental touching at the time of cartridge exchange, which could occur if the wire were not drawn to the front side but left on the back side, can be avoided.

Further, as wire 9 is connected through the second cut-and-raised portion 11*b* provided between the first cut-and-raised portion 11*a* and fixing unit 5 to substrate portion 10, contact of wire 9 with relatively hot fixing unit 5 or contact with motor 6 can be avoided. Consequently, thermal damage to wire 9 can be prevented, and use of wire material having high heat-resistance becomes unnecessary. This leads to lower cost. Further, wire 9 does not contact a series of gears (not shown) linked to motor 6, and connected, with a relatively short distance, to substrate portion 10, and therefore, influence of noise can be suppressed.

In this manner, in laser printer apparatus 1 having motor 6 arranged inside frame 12 for size reduction, it is possible to connect wire 9, which connects detecting portion 8 to substrate portion 10, with a relatively short distance and at a lower cost, by routing the wire through the first and second cut-and-raised portions 11*a* and 11*b* formed on base member 11 on which motor cover 7 with detecting unit 8 is attached.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A laser printer apparatus, comprising:

a pair of frames arranged opposite to each other;

a base member fixed on each of said pair of frames to extend across said pair of frames;

a photoreceptor arranged below said base member and transferring toner for printing an image on a prescribed sheet of paper;

a cartridge arranged below said base member and opposite to said photoreceptor, for supplying toner;

a laser scanning unit arranged on said base member for irradiating said photoreceptor with a laser beam based on a prescribed image signal;

a fixing unit arranged above said photoreceptor and next to said base member, for fixing the toner transferred onto the sheet of paper;

a motor arranged inside one of said pair of frames, for applying driving power to feed the sheet of paper;

a cover member attached to said base member and covering said motor from below;

a detecting portion attached to said cover member for detecting presence/absence of said cartridge;

a substrate portion arranged outside said one frame, for controlling a printing operation; and a wire connecting said detecting portion with said substrate; wherein said base member includes a first cut-and-raised portion for holding said motor cover, and a second cut-and-raised portion formed, spaced apart from said first cut-and-raised portion, between said motor and said fixing unit; and said wire is drawn through a gap between said motor cover and said first cut-and-raised portion, held by said second cut-and-raised portion and connected to said substrate portion.

2. A laser printer apparatus having a laser scanning unit, comprising:

a prescribed base member on which the laser scanning unit is placed;

a detecting portion arranged below one of a pair of first end portions opposite to each other of said base member, for detecting presence/absence of a cartridge put in/taken out along a prescribed direction for supplying toner for printing an image;

a driving portion arranged on a side of said one first end portion of said base member, for feeding a sheet of paper;

a fixing unit arranged next to said base member on a side of one of a pair of second end portions of said base member opposite to each other in a direction approximately orthogonal to the direction in which said pair of first end portions oppose, for fixing toner transferred onto the sheet of paper;

a substrate portion arranged on that side of said driving portion which is opposite to the side of said base member, for controlling a printing operation; and a wire connecting said detecting portion with said substrate portion; wherein said wire extends from said detecting portion through a prescribed through-opening of said base member, passes between said driving portion and said fixing unit, and is connected to said substrate.

3. The laser printer apparatus according to claim 2, further comprising a driving portion covering member attached to said base member for covering said driving portion from below; wherein said prescribed opening is a gap formed in the base member on the side of said fixing unit, at an attachment portion between said driving portion covering member and said base member.

4. The laser printer apparatus according to claim 3, wherein said gap is formed by a first cut-and-raised portion provided in said base member for holding said driving portion covering member.

5. The laser printer apparatus according to claim 2, further comprising a second cut-and-raised portion formed at said one second end portion on the side of said fixing unit of said base member; wherein said wire is held by said second cut-and-raised portion and connected to said substrate.

6. The laser printer apparatus according to claim 2, further comprising a pair of frames respectively supporting said pair of first end portions of said base member; wherein said substrate portion is arranged outside said frames.

* * * * *